US005313992A

United States Patent [19]

Grabenkort

[11] Patent Number: 5,313,992

[45] Date of Patent: May 24, 1994

[54] TRANSFER TUBING SET FOR COMPOUNDING SOLUTIONS

[75] Inventor: Richard W. Grabenkort, Barrington, Ill.

[73] Assignee: Abbott Laboratories, Abbott Park, Ill.

[21] Appl. No.: 989,422

[22] Filed: Dec. 11, 1992

[51] Int. Cl.[5] ..... B65B 1/04; B65B 3/04

[52] U.S. Cl. ..... 141/104; 141/105; 604/151; 137/566

[58] Field of Search ..... 141/100, 104, 105, 83; 604/151, 152, 153, 154, 155; 137/566

[56] References Cited

U.S. PATENT DOCUMENTS

| | | | |
|---|---|---|---|
| 4,718,467 | 1/1988 | DiGianfilippo et al. | 141/105 |
| 4,842,584 | 6/1989 | Pestrone | 604/153 |
| 5,040,699 | 8/1991 | Gangemi | 141/104 |
| 5,062,774 | 11/1991 | Kramer et al. | 417/413 |
| 5,085,256 | 2/1992 | Kircher et al. | 141/104 |

*Primary Examiner*—Henry J. Recla
*Assistant Examiner*—Steven O. Douglas
*Attorney, Agent, or Firm*—A. Nicholas Trausch

[57] ABSTRACT

The present invention relates to a fluid transfer tubing set assembly including a disposable pumping component, tubing component, a tray component for organizing the tubing, a handle component for the pumping component and a packing box which facilitates easy and proper assembly.

8 Claims, 6 Drawing Sheets

32
78
76
16

32
56
80
14

TRANSFER TUBING SET FOR COMPOUNDING SOLUTIONS

FIELD OF THE INVENTION

The present invention generally relates to preparing admixtures of parenteral solutions and, more particularly, to a fluid transfer tubing set for transferring individual fluids from multiple supply containers through a positive displacement pumping component to a single receiving container.

BACKGROUND OF THE INVENTION

Hospital pharmacists are increasingly compounding solutions for parenteral administration to a patient which contain a multiplicity of solutions in a single solution container. Such parenteral solutions include those formulated for nutritional purposes, as well as drug-containing admixtures for therapeutic purposes. A basic nutritional solution, for example, contains amino acids, dextrose, and fat emulsions which provide a major portion of the patient's nutritional needs. These solutions are typically compounded by use of a large volume parenteral compounder which typically utilizes a peristaltic type pump. A peristaltic-type pump is sufficient for large volume parenteral solution compounding since the pump transfers large volumes in an efficient and accurate manner. However, in addition to the basic solutions, a typical total parenteral solution also includes as many as ten additional additives, such as small quantities of vitamins, electrolytes, minerals, etc. These components are typically drawn into individual syringes and then injected into the final solution container. This procedure, while accurate, requires a large amount of time on the part of the pharmacist. Additionally, the repeated needle puncturing in the additive solutions increases the risk of contamination and accidental needle stick.

Accordingly, automatic compounding systems are being increasingly used for measuring and combining the smaller volume additives to the parenteral solutions. While small volume peristaltic pumps are in current use for small volume compounding, it is highly desirable to utilize a fast and highly accurate diaphragm cassette pump for compounding the additives to previously prepared large volume parenteral solutions. Additionally, it is highly desirable to use the high accuracy pump cassette for preparing small volume admixtures for therapeutic purposes, as well as small volume parenteral solutions for neonatal administration.

SUMMARY OF THE INVENTION

The present invention relates to a fluid transfer tubing set for transferring multiple individual fluids from multiple supply containers through a pumping chamber of a positive displacement pump component to a single receiving container. Specifically, the transfer set includes multiple fluid ports connected in a serial flow path in the pumping component, such as, for example, a pumping diaphragm cassette. The pumping component includes a fluid outlet port at one end of the serial flow path, a flush fluid inlet port at the other end of the serial flow path, a fluid recirculation port and at least one supply fluid inlet port between the outlet port and the recirculation inlet port. The transfer set also includes a plurality of individual fluid inlet conduits, each inlet conduit individually connecting one of the supply containers to one of the supply fluid inlet ports in the pumping component. Further, the transfer set includes a fluid outlet conduit connecting the fluid outlet port of the pumping component with the receiving container. A flow coupler is fluidly connected with the fluid outlet conduit adjacent to the receiving container. A fluid recirculation conduit connects the fluid recirculation port of the pumping component with the fluid coupler so as to selectively allow fluid flow through the recirculation conduit in alternate directions. Also, a final outlet fluid conduit connects the fluid coupler with the receiving container and has a fluid volume less than the fluid volume of the pumping chamber of the positive displacement pumping component.

In accordance with the present invention, multiple pumping diaphragm cassettes can be fluidly coupled together so as to optimize the number of supply containers available to the automatic system. The fluid coupling allows recirculation of the admixed fluid from the receiving container sequentially through the flow path of each cassette so as to reduce the use of flush solution to flush incompatible solutions from the cassette.

The present invention also includes components for packaging and organizing the plurality of fluid inlet conduits associated with the multiple cassettes prior to connection to the multiple supply containers. For example, one packaging and organizing component is a molded tray having retaining mechanisms built into the tray to position the tray relative to the supply containers and the pumping apparatus.

The invention further includes a component, such as a bracket forming a handle, for fixing multiple diaphragm cassettes in a fixed relationship prior to simultaneous positioning in the pump apparatus.

As the transfer set for I.V. pumps and compounding pumps become more complex, a need arises to be able to package and present the disposable transfer set in such a way that it helps the user to install and connect it properly. The present invention codes the various tubing components to be assembled and positions them in a multi-pocket tray in such a way that the correct placement of the various components is assured. The tray helps greatly in the manufacturing fabrication and end-user assembly steps. Once the disposable tubing set has been assembled, it can be placed in the packaging tray that orients the tubing connections in such a way that the end user is presented with a very complex product that has been pre-organized and oriented such that the transfer set can easily and efficiently be installed. Also, the packing box that packages the bracket handle and tray is configured so that the user can reliably position and properly orient the components prior to making the inlet connections. Finally, the connecting bracket for multiple cassette embodiments can be used as a handle that allows one-handed manipulation and loading of the plural cassettes.

Numerous other features and advantages of the present invention will become readily apparent from the following detailed description, the accompanying drawings, and the appended claims.

Figure 1:
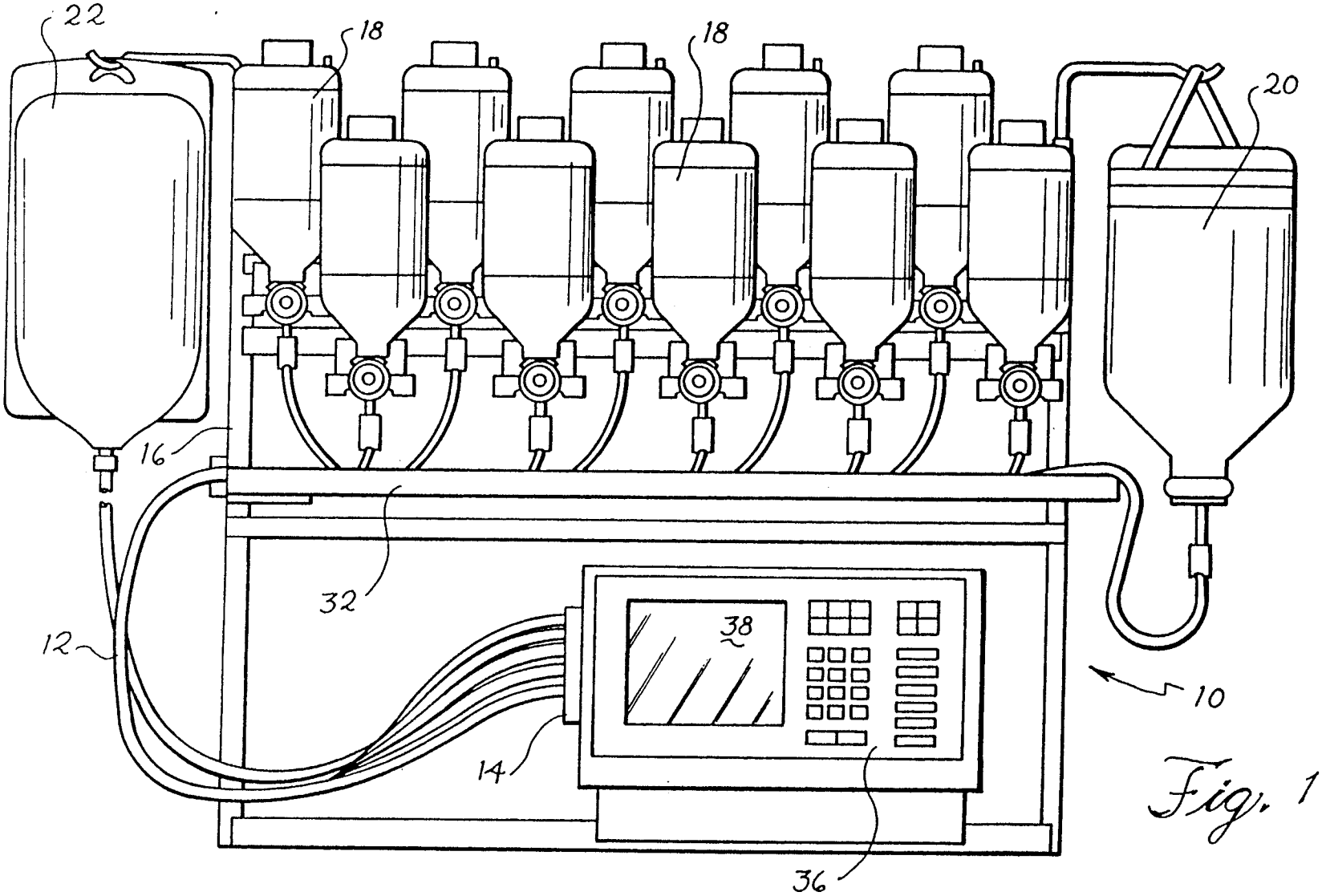
FIG. 1 is a front view of a positive displacement pump apparatus having multiple supply containers and a single receiving container which are fluidly connected by the transfer tubing set of the present invention.

While the present invention is susceptible of embodiments in various forms, there is shown in the drawings and there will hereinafter be described a presently preferred embodiment, with the understanding that the present disclosure is to be considered as an example of the invention, and is not intended to limit the invention to the specific embodiment illustrated.

DESCRIPTION OF THE PREFERRED EMBODIMENT

Referring now to FIG. 1 of the drawings, there is illustrated a positive displacement pumping apparatus 10 such as the Nutrimix® Micro Compounder manufactured by Abbott Laboratories. The pump apparatus utilizes a microprocessor to control a step motor which operates the positive displacement pump plunger and solenoids which actuate the pump valves. A disposable transfer tubing set assembly, generally 12, includes a disposable cassette component 14 and an associated tubing conduit component. The plunger and valves operate on the positive displacement pump chamber and multiple inlet valves contained in the disposable diaphragm cassette 14. As will be recognized by those familiar with the cassette pumping art, the features of the pumping apparatus and compounding cassette are similar to those found in the pumps and cassettes disclosed in U.S. Pat. No. 4,818,186, to Pastrone et al., U.S. Pat. No. 4,842,584, to Pastrone, and U.S. Pat. No. 4,927,411 to Pastrone et al., which patents are all assigned to Abbott Laboratories and which are hereby incorporated by reference in the present disclosure. The disclosure of the above patents, which are commonly assigned to the assignee of the present invention, relate to a pump cassette and associated pump driver employed for the infusion of parenteral solution. However, many of the principles disclosed therein are equally applicable in connection with the present invention as it relates to small volume compounding as well as large volume compounding.

Additional components of the compounder include a supply rack 16 for holding multiple supply containers 18 such as small volume solution containers from 10 mL to 250 mL in volume size. A flush solution container 20 is also provided as well as a single patient container such as flexible receiving container 22. Since flush container 20 and patient receiving container 22 are typically large volume containers, they may be hung off of the supply rack 16.

The transfer tubing set assembly, generally identified as 12, provides a sterile fluid pathway from the supply containers 18 to the patient container 22. A packaging tray such as thermoformed tray 32 holds and organizes the fluid inlet conduits of the transfer tubing set prior to connection to the supply inlet containers. Other notable components of the pumping apparatus include data entry keys 36 and display screen 38.

Figure 2:
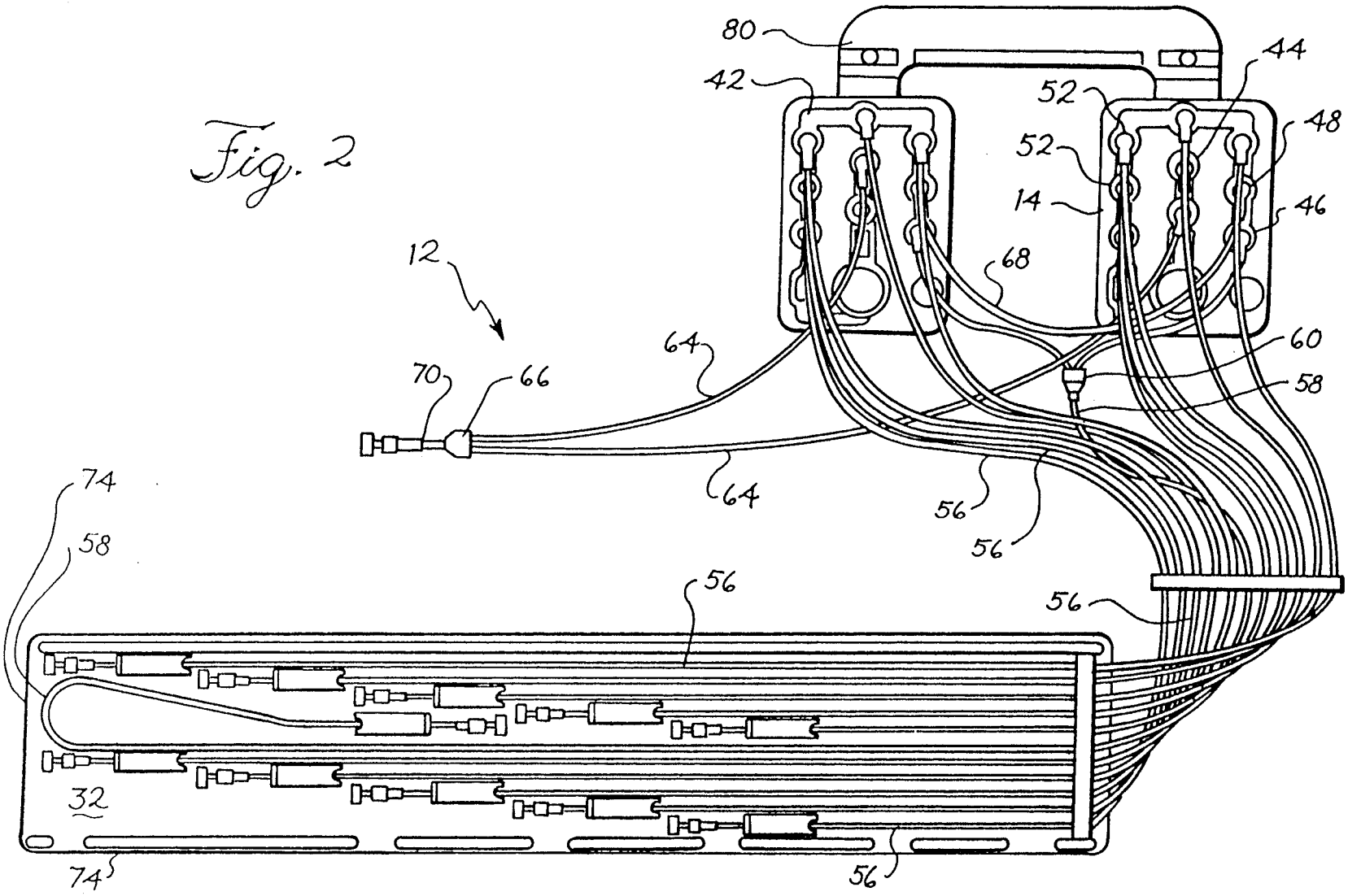
FIG. 2 is a plan view of the transfer tubing set in a packaging tray according to the present invention prior to the tubing component being connected with the pump apparatus and the supply containers.

Referring now to FIG. 2, the fluid transfer tubing set assembly 12 will be more specifically described. A positive displacement pumping component is generally shown by disposable diaphragm cassette 14. This cassette is similar to the multiple inlet cassette described and shown in U.S. Pat. No. 5,082,014 to Olichney and U.S. Pat. No. 5,062,774 to Kramer et al., both of which patents are assigned to Abbott Laboratories and both of which are hereby incorporated by reference. The pumping cassette 14 is characterized by multiple fluid ports connected in a sterile fluid flow path. The preferred cassette embodiment of the present invention includes a fluid flow path generally shown by 42. The flow path includes a fluid outlet port 44 at one end of the flow path and a flush fluid inlet port 46 at the other end of the serial flow path. A fluid recirculation port 48 is located between the outlet port 44 and the flush fluid inlet port 46, preferably adjacent the flush inlet port 46. At least one, and preferably a plurality of supply fluid inlet ports 52, are also located between the outlet port 44 and the flush fluid inlet port 46.

In the preferred embodiment shown in FIG. 2, each cassette has five supply fluid inlet ports. In a typical hospital pharmacy for small volume compounding using an automatic pumping apparatus, the number of supply containers which are frequently used is typically between five and ten different solutions. Therefore, the preferred embodiment of the present invention is shown with an optimized configuration having the potential and flexibility for up to ten supply containers. This is achieved by connecting two cassettes, such as 14, together in serial flow communication.

The tubing component of the transfer set assembly includes a plurality of individual fluid inlet conduits 56. As shown in FIG. 2, one fluid inlet conduit is provided to individually connect one of the supply containers 16 (shown in FIG. 1) to one of the supply fluid inlet ports 52. The actual piercing connection is made by piercing pins (not shown).

A fluid flush conduit 58 is provided to connect the flush container 20 to the fluid flush inlet port 46 in the pumping component. As shown in the dual cassette embodiment in FIG. 2, the fluid flush conduit 58 is divided at flush divider 60 so as to provide flush fluid to both flush fluid inlet ports 46.

The transfer set further includes a fluid outlet conduit 64 connecting the fluid outlet port 44 of the pumping component with the receiver container 22. A fluid coupler 66 is provided to couple the fluid outlet conduits 64 from both cassettes. The fluid coupler 66 is connected with the fluid outlet conduit 64 adjacent to the receiving container in the preferred embodiment as shown in FIGS. 1 and 2.

Figure 5:
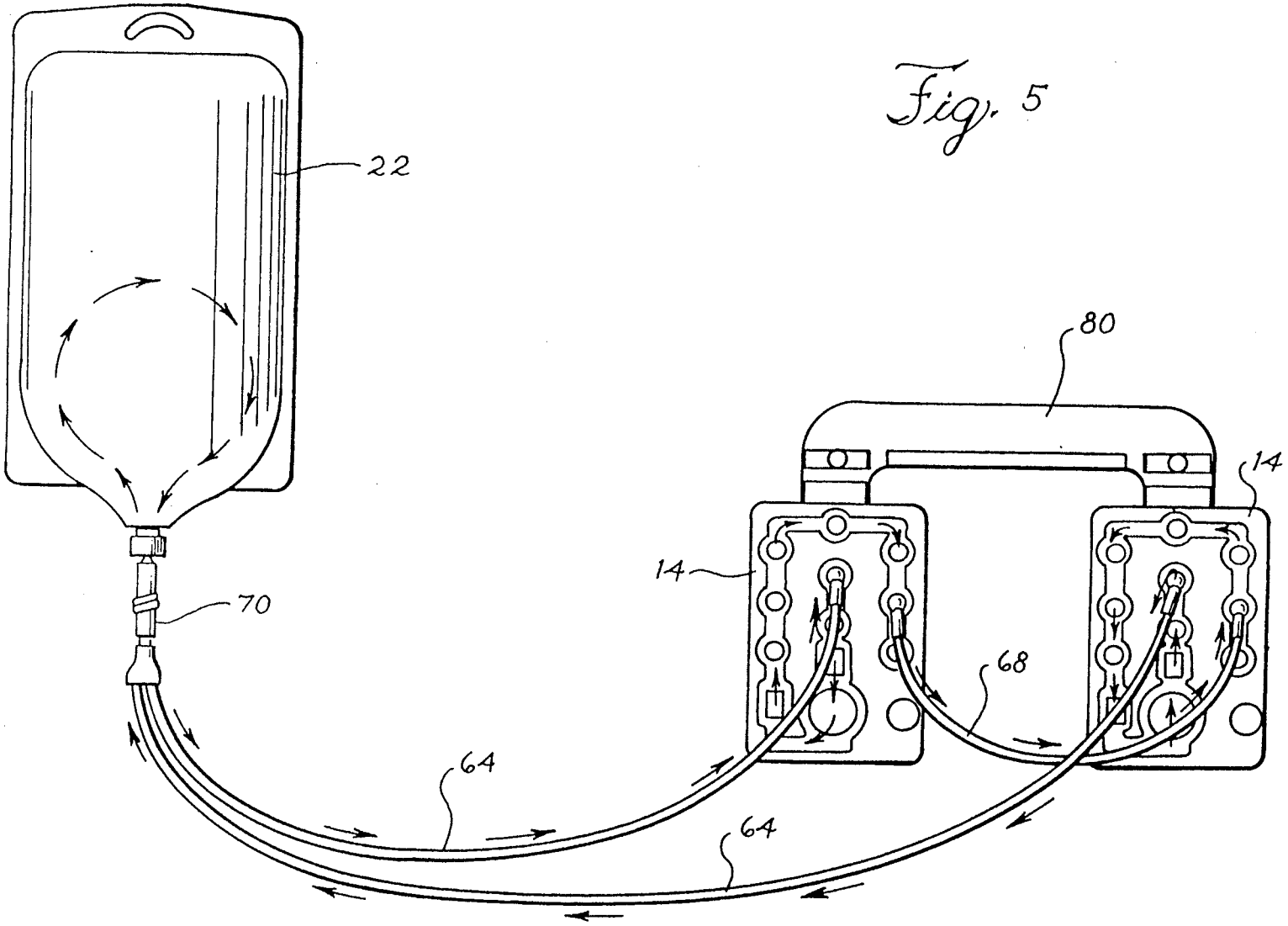
FIG. 5 is a schematic of a two-cassette embodiment of the present invention showing a typical recirculation procedure from the receiving container according to the present invention.

A fluid recirculation conduit 68 connects the fluid recirculation ports 48 of both cassettes. The fluid recirculation conduit allows the pumping apparatus to selectively pump mixed solution from the receiving container through the recirculation conduit, as seen in FIG. 5. The recirculation can be in alternate directions.

The transfer set further includes a final outlet fluid conduit 70 connecting the fluid coupler 66 with the septum of a receiving container 22 by means of a needle for example. The final outlet fluid conduit has a fluid volume less than the fluid volume of the pumping chamber of the positive displacement pumping cassette.

The transfer set further includes a packaging component for initially holding and organizing the plurality of fluid inlet conduits 56 prior to connection to the multiple supply containers. In the preferred embodiment, these components include a multi-pocketed tray 32 that efficiently organizes the various tubing components in the tray in an orderly manner. The tray helps greatly in the assembly steps of the transfer tubing set. Also, the tray allows the tubing set to be easily positioned relative to the supply containers and the positive displacement pump apparatus prior to connection of the individual supply lines. As shown, for example in FIGS. 2 and 4, the tray includes a perimeter flange 74. One end of the tray flange 74 is slipped into a tray retaining mechanism 76 associated with the supply rack 16. The rack also includes a snap fitment 78 for connection to the flexible flange so as to secure the opposite end of the tray relative to the supply rack.

The transfer set assembly further includes a joining component for securing multiple pump diaphragm cassettes in a fixed relationship. For example, in FIG. 2, a bracket 80 is shown joining the two cassettes 14 in a fixed distance and parallel orientation relationship. The bracket is constructed in such a manner that the cassettes are generally fixed in relation to each other, yet the bracket has enough flex that the position and orientation of the cassettes can accomodate any tolerance differences or other incidental misalignment in the bracket or the access mechanism for the cassette in the pump apparatus.

Figure 3:
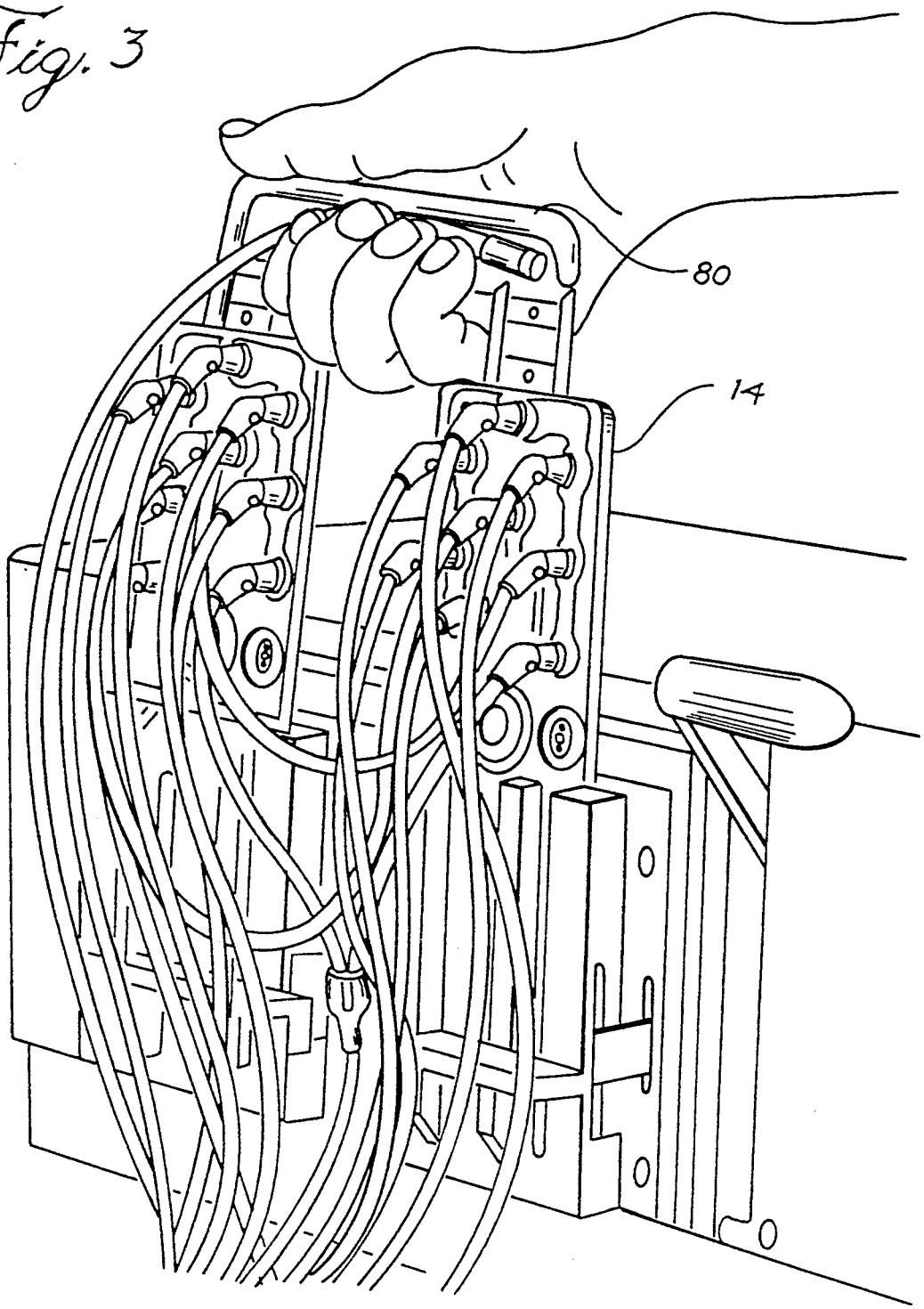
FIG. 3 is a view of a two-cassette handle bracket during loading into the positive displacement pump door mechanism.
Figure 4:
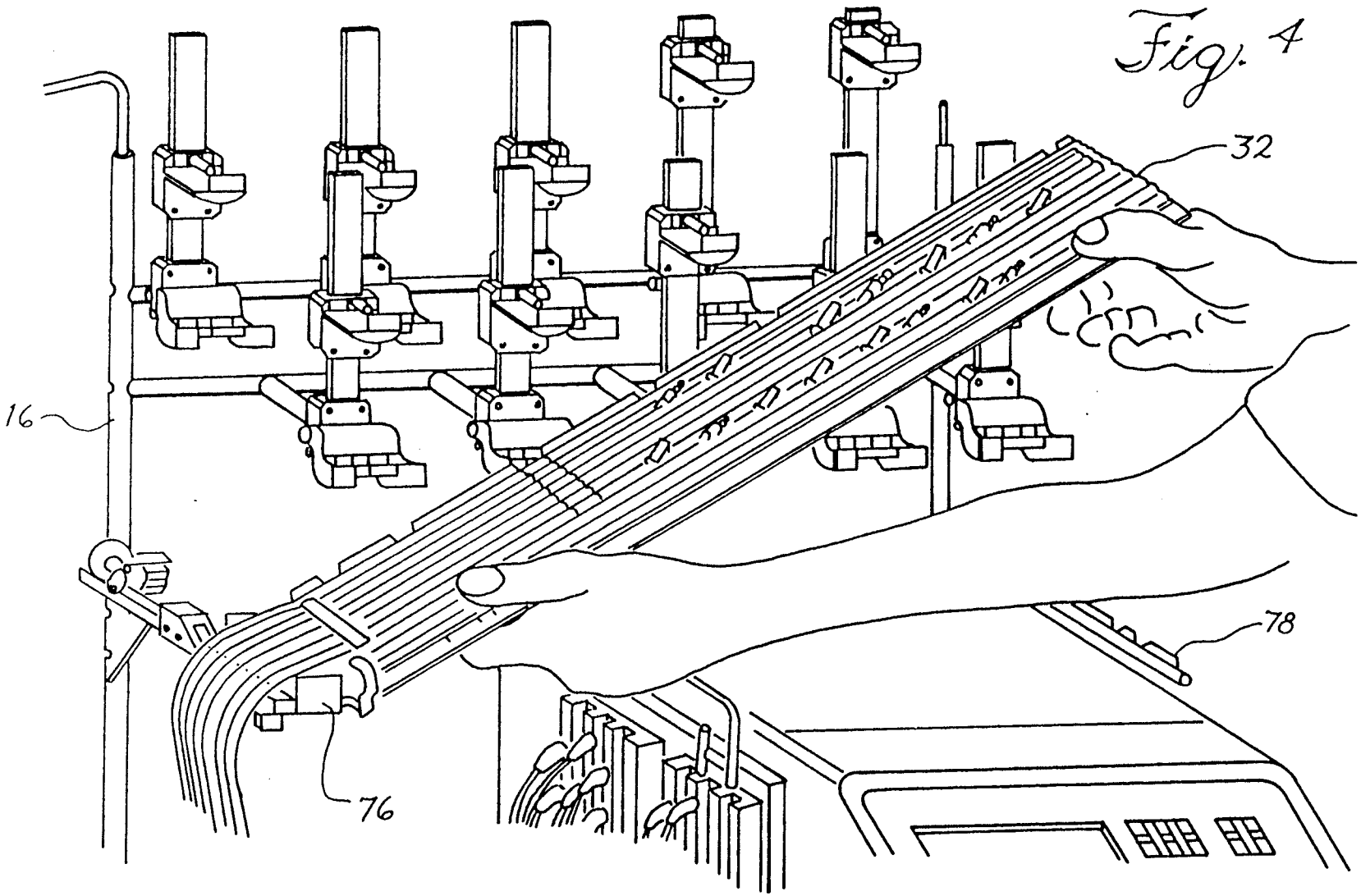
FIG. 4 is a view of the packaging tray holding the transfer set according to the present invention while the tray is being positioned in the first tray retainer of the pump apparatus.

As shown in FIG. 3, this bracket allows multiple cassettes to be easily and simultaneously seated in an operating position in the cassette door guide of a positive displacement pump apparatus. The bracket conveniently serves as a handle for one hand manipulation of the pump cassettes 14 while the other hand of the operator can hold the packaging tray 32. Once the multiple cassettes are in position, both hands can be used to position the tubing tray as shown in FIG. 4.

Figure 6:
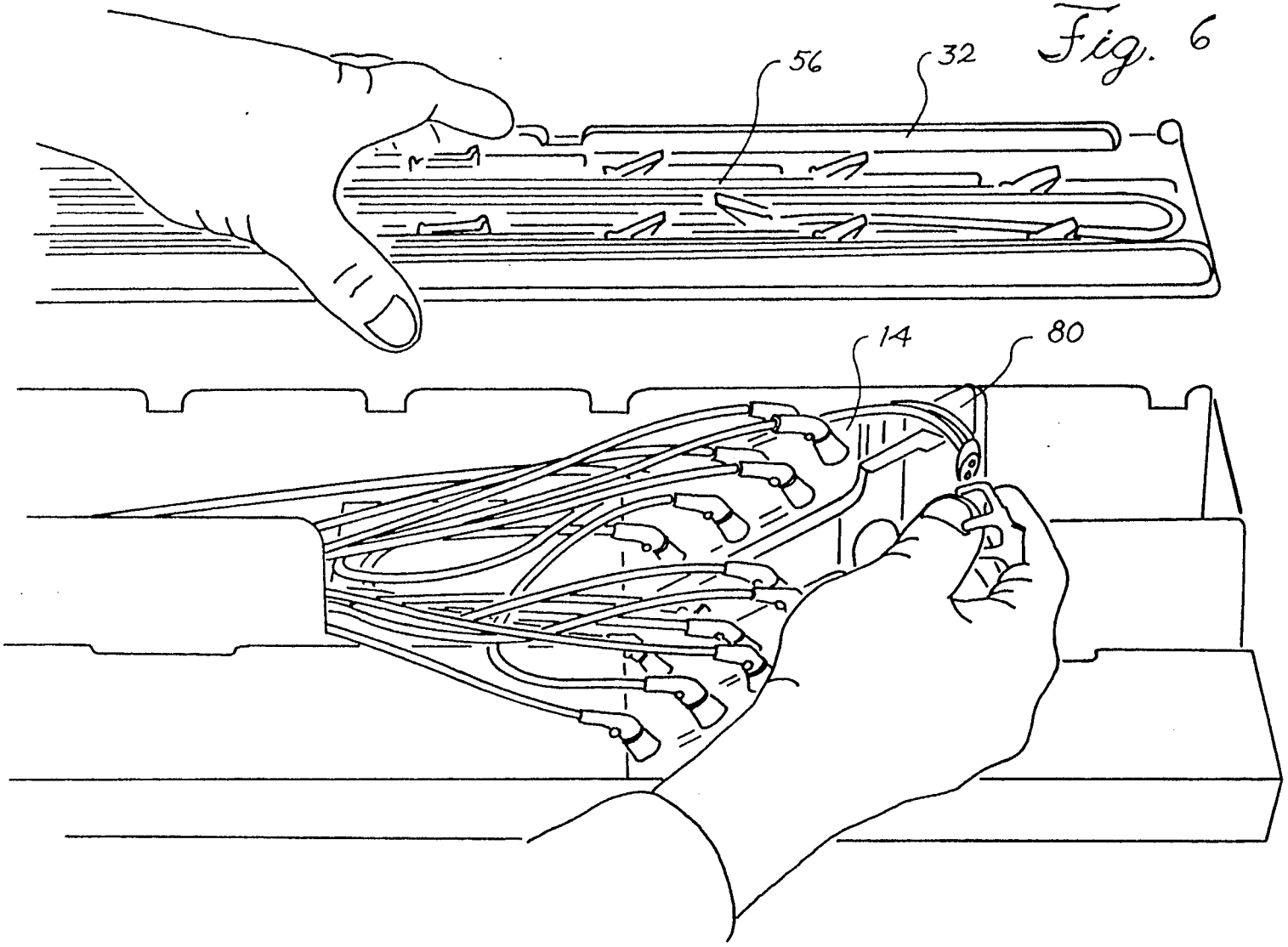
FIG. 6 is a schematic of the packing box that holds the tray and handle bracket.

Further, as seen in FIG. 6, the holding and organizing components of this invention are transported in a packing box. The packing box naturally and properly orients the tray and the handle bracket in positions that facilitate the end-user easily and properly assemblying the transfer set to the pump apparatus. Thus, the tray is positioned on the top layer of the box while the handle bracket with cassettes is located on the lower level. These positions correspond to the final assembled positions relative to the pump apparatus. The packing box thus facilitates the natural and proper assembly of the transfer set to the pump apparatus.

From the foregoing, it will be observed that numerous modifications and variations can be affected without departing from the true spirit and scope of the invention. It is to be understood that no limitation with respect to the specific embodiment illustrated here is intended. The disclosure is intended to cover all modifications which fall within the scope of the appended claims.

I claim:

1. A fluid transfer tubing set assembly for transferring individual fluids from multiple supply containers to a single receiving container, the assembly comprising:

a flow path including a pumping component and a tubing component, the pumping component comprising at least two pumping diaphragm cassettes operable with a positive displacement pump apparatus and each cassette having a fluid outlet port at one end, a flush fluid inlet port at the other end, a fluid recirculation port and at least one supply fluid inlet port between said outlet port and said flush fluid inlet port, the tubing component having a plurality of individual fluid inlet conduits for fluidly connecting a supply container to a fluid inlet port, a fluid outlet conduit for fluidly connecting said fluid outlet port with said receiving container, a fluid recirculation conduit for fluidly connecting each fluid recirculation port with each other recirculation port so as to allow fluid flow through the fluid recirculation conduit and the fluid outlet conduit in selectively alternate directions, and a coupling means fluidly coupling the fluid outlet conduits of said at least two cassettes so as to allow recirculation from the receiving container sequentially though the flow path of each cassette;

and packaging means for initially holding and organizing the tubing component prior to connection.

2. The transfer set of claim 1 further including means for joining said at least two cassettes in fixed relationship.

3. The transfer set of claim 2 wherein said packaging means includes a molded tray.

4. The transfer set of claim 3 wherein said molded tray includes means for retaining the tray in position relative to the supply containers and the positive displacement pump apparatus.

5. The transfer set of claim 4 wherein said retaining means includes a perimeter flange around the tray, one end of said tray flange fitting in a tray retainer on said pump apparatus and an opposite end of the tray flange flexibly attaching to a snap fittment associated with the pumping apparatus.

6. The transfer set of claim 3 wherein said packaging means also includes a packing box that facilitates proper assembly of the transfer set.

7. The transfer set of claim 1 further including means for holding said at least two pumping diaphragm cassettes in fixed relationship for simultaneous positioning in an operating position in the positive displacement pump apparatus.

8. The transfer set of claim 7 wherein said holding means is a bracket forming a handle between two cassettes.

* * * * *